US008931220B2

(12) United States Patent
Stewart et al.

(10) Patent No.: US 8,931,220 B2
(45) Date of Patent: Jan. 13, 2015

(54) INSULATING ICF WINDOW BUCK WITH INTEGRATED FASTENING AND ANCHORS

(71) Applicant: Gorilla Buck Inc., Pelican Rapids, MN (US)

(72) Inventors: Cooper Edward Stewart, Pelican Rapids, MN (US); Robert James Johnson, Pelican Rapids, MN (US)

(73) Assignee: Gorilla Buck Inc., Pelican Rapids, MI (US)

( * ) Notice: Subject to any disclaimer, the term of this patent is extended or adjusted under 35 U.S.C. 154(b) by 0 days.

(21) Appl. No.: 13/677,253

(22) Filed: Nov. 14, 2012

(65) Prior Publication Data

US 2014/0130431 A1 May 15, 2014

Related U.S. Application Data

(60) Provisional application No. 61/629,149, filed on Nov. 14, 2011.

(51) Int. Cl.
*E06B 1/04* (2006.01)

(52) U.S. Cl.
USPC ..... 52/215; 52/309.12; 52/656.5; 49/504; 249/39

(58) Field of Classification Search
USPC ..... 52/204.1, 215, 216, 426, 427, 656.5, 52/745.16, 699, 309.12; 249/36, 39; 49/504, 505, DIG. 1
See application file for complete search history.

(56) References Cited

U.S. PATENT DOCUMENTS

| | | | | | |
|---|---|---|---|---|---|
| 2,166,870 | A * | 7/1939 | Livesay | 52/213 |
| 2,893,235 | A * | 7/1959 | Goldberg | 52/204.55 |
| 3,160,926 | A * | 12/1964 | Brose | 49/401 |
| 3,230,676 | A * | 1/1966 | Dixon | 52/223.1 |
| 3,439,894 | A * | 4/1969 | Haider | 249/39 |
| 4,430,831 | A * | 2/1984 | Kemp | 52/204.53 |
| 5,458,828 | A * | 10/1995 | Chuang | 264/35 |
| 5,746,033 | A * | 5/1998 | Chuang | 52/213 |
| 5,843,323 | A * | 12/1998 | Ranard | 249/39 |
| 5,996,293 | A * | 12/1999 | Anderson et al. | 52/215 |
| 6,070,375 | A * | 6/2000 | Anderson et al. | 52/204.54 |
| 7,587,868 | B2 * | 9/2009 | Hughes | 52/215 |
| RE43,251 | E * | 3/2012 | Anderson et al. | 52/204.54 |
| RE43,457 | E * | 6/2012 | Anderson et al. | 52/215 |
| 8,458,969 | B2 * | 6/2013 | Richardson et al. | 52/215 |

(Continued)

*Primary Examiner* — Basil Katcheves
*Assistant Examiner* — Rodney Mintz
(74) *Attorney, Agent, or Firm* — Dardi & Herbert, PLLC.; Curtis B. Herbert; Kayla J. Fossen

(57) ABSTRACT

An insulated window buck with integrated fastening and anchor elements for a self aligning cut or molded insulated concrete form (ICF) window buck. The insulated window buck with integrated fastening and anchor generally includes an insulated ICF window and door buck made with multiple components with a configuration that allows for the use of various type of materials' on the face and edges of the buck, and have the ability to friction fit to the inside of an ICF wall so as no external bracing or strapping is needed to keep the buck aligned with the ICF wall during concrete placement. Having a firm insulation material component on the internal portion of the buck is an integral part of the invention in that through the use of recesses in the insulation material the fluid concrete can flow into these recesses and make a permanent bond to the buck. Also having the ability to use single or multiple insulation pieces to make up the insulating and friction fit element of the buck is an integral part of the invention.

20 Claims, 13 Drawing Sheets

(56) References Cited

U.S. PATENT DOCUMENTS

| | | | | |
|---|---|---|---|---|
| 8,495,843 | B1 * | 7/2013 | Horneland | 52/215 |
| 8,544,224 | B1 * | 10/2013 | Hafendorfer et al. | 52/215 |
| 8,752,345 | B1 * | 6/2014 | Kometas | 52/215 |
| 2003/0005659 | A1 * | 1/2003 | Moore, Jr. | 52/473 |
| 2006/0151677 | A1 * | 7/2006 | McIvor et al. | 249/36 |
| 2007/0204535 | A1 * | 9/2007 | Hughes | 52/215 |
| 2008/0115431 | A1 * | 5/2008 | Mill | 52/215 |
| 2009/0193729 | A1 * | 8/2009 | Kustermann | 52/215 |
| 2009/0205272 | A1 * | 8/2009 | Rosende | 52/215 |
| 2010/0071306 | A1 * | 3/2010 | Williams et al. | 52/712 |
| 2010/0154329 | A1 * | 6/2010 | Adkins et al. | 52/204.1 |
| 2010/0251645 | A1 * | 10/2010 | Philippe | 52/215 |
| 2010/0269433 | A1 * | 10/2010 | Westra | 52/215 |
| 2011/0083382 | A1 * | 4/2011 | Sanders | 52/215 |
| 2011/0185661 | A1 * | 8/2011 | Nauck et al. | 52/309.4 |
| 2011/0214370 | A1 * | 9/2011 | Stewart | 52/215 |
| 2012/0005975 | A1 * | 1/2012 | Kim | 52/209 |
| 2012/0186172 | A1 * | 7/2012 | Bouchard | 52/204.1 |
| 2014/0130432 | A1 * | 5/2014 | Stewart | 52/215 |

* cited by examiner

INSULATING ICF WINDOW BUCK WITH INTEGRATED FASTENING AND ANCHORS

RELATED APPLICATIONS

This application claims priority to U.S. Provisional Application No. 61/629,149 filed Nov. 14, 2011 which is hereby incorporated by reference in its entirety.

BACKGROUND OF THE INVENTION

1. Field of the Invention

The present invention relates generally to insulated concrete form (ICF) window and door bucks and more specifically it relates to an insulated ICF window and door buck with integrated alignment, fastening, anchoring, and reinforcing elements.

2. Description of Related Art

Insulated concrete forms (ICF's) are used as the form work for constructing concrete walls. Typically ICF's use a pair of opposing parallel insulating panels either in a component (knock down) format or as one piece element/block with an open cavity between the panels for accepting the poured concrete. Typically the insulating panels are left in place after concrete placement thereby providing insulation for the finished wall. The ICF insulating panels have interior surfaces which face the cavity and exterior surfaces to the panels which wall finishes can be applied to. The insulating panels of the ICF's can be of various shapes and sizes with some interiors being flat, undulating or grooved with a wide array of ties or connectors holding the panels in place for concrete placement and finishing.

Openings in the concrete walls are typically formed in place prior to concrete placement with the use of a window or door buck frame which are typically left in place as a rough opening. Window and door bucks are typically made from flat lumber stocks being either treated or non-treated and supported within the opening by way of additional wall strapping which is removed after the concrete has cured. Another method for framing window and door bucks is to use an inset buck that fits into the wall form cavity and is held in place with either integrated grooves or with fasteners that penetrate the form work material into the buck frame material with the buck firmly secured in position inside the wall cavity. Another method for framing a window and door buck is to use a "flat stock material" shaped profile with integrated exterior strapping that holds the buck securely in place during concrete placement with the integrated strapping remaining permanently in place.

Existing buck materials and designs known in the art result in a variety of problems due to exterior fins (strapping) adding thickness to the overall wall width, having to fight that extra thickness around door and window openings during finishing and by having an exterior fin making it difficult to drain water to the exterior from the tops of the window and door openings. With the insulating buck solutions that have been invented the builder has difficulties in waterproofing the openings and in providing solid anchoring to the concrete wall core. Other short comings in the prior art is having to add components or additional labor around each buck for securely positioning reinforcement elements in the proper positions and also providing for additional anchoring to the concrete to keep the buck permanently in position and for supporting additional loads that can be applied to the buck frame.

As a result from the deficiencies and problems associated with the foregoing there is a need in the building construction art for a more reliable, dependable, and complete window and door buck solution for providing framed openings in poured concrete wall forms such as ICF's.

SUMMARY OF THE INVENTION

The invention generally relates to an insulated concrete form window and door buck that can be made with multiple components with a configuration that allows for the use of various type of components for aligning with ICF wall blocks, and have the ability to friction fit to the inside of an ICF wall so as no external bracing or strapping is needed allowing for the free drainage of water to the outside and to keep the buck aligned with the ICF wall during concrete placement. Having a firm insulation material component on the body portion of the buck is an integral part of the invention in that through the use of integrated reinforcing alignment elements and anchor insertion cavities allow for the incorporation of alignment elements. Fastening elements and the anchoring components provide a permanent bond of the buck to the concrete core and enabling the alignment of reinforcing and the attachment of additional elements to the face and edges of the buck.

Buck tie and fastening elements are made up of a cross tie element that can be configured for add on reinforcement alignment elements or manufactured as one piece components. The cross ties can have indentations, slots, holes, protrusions, slides, clips or a multitude of other joining mechanisms for integrating anchors and or reinforcing alignment elements. The outside parallel edges of the overall tie fastening elements have edge fastening flanges and can have designated points with extra strength for attaching heavier loads. These edge flanges also allow for the attachment of window and door units and other finish materials. The buck tie and fastening elements can be manufactured as a single component or in multiple components so individual elements such as the cross tie elements can be manufactured as a separate add on component to the edge fastening flanges.

A pair of insulated concrete form side panels that have an inside face, and exterior face and the panels having edges on the top sides and bottoms, the side panels have a system of webs that hold the parallel side panels in position during concrete placement, and the wall assembly is made up from individual ICF blocks, with the entire wall core being filled with concrete and reinforcing rods. Standard metal or wood concrete wall forms can be fitted with insulation prior to concrete placement and the molded buck sections work equally well in this application.

The molded buck sections can have buried fastening elements or exposed fastening elements. The molded buck sections also have internal and external faces that can have anchor insertion points and either insulated or non-insulated internal alignment elements. The molded buck has an exposed buck face which is ready for applying finish materials or door or window units. Either the exposed face of the buck and or the internal face of the buck can have anchor points designated on the surfaces showing where to fasten and where to cut or where to insert additional anchor elements on the job site.

Internal reinforcing alignment brackets can be configured in a multitude of ways which include fixed alignment brackets, hinged alignment brackets or slide or clip on alignment brackets with locations for reinforcing rods and stop elements on the top of the brackets to engage the cross ties which they integrate with. The bracket may also be made as a one piece element with the cross tie and edge fastening elements as a single unit.

The cross tie edge fastening elements can have slots or attachment mechanisms for combining with a cut in slide in, on site concrete anchor, which helps tie the buck assembly to the concrete core.

An object is to provide a molded ICF window and door buck with the main body of the buck being insulated so as to provide better energy efficiency of the completed building around the installed windows and doors, with the option of the internal alignment elements being made from insulating materials as well.

Another object is to provide a molded ICF window and door buck with integrated fastening elements for the edges and faces of the buck for attaching window and door units, trims and other finish elements including face and edge materials, with the integrated fastening elements being made from a wide array of materials with the end goal of being able to support the attachment of additional materials after the concrete pour.

Another object is to provide an ICF window and door buck with integrated concrete anchoring that can provide the ability of bonding the embedded edge and face fastening elements of the buck to the concrete core providing additional strength to the buck itself and for the fastening elements that can have the addition of finish elements tying all components back to the concrete core.

Another object is to provide integrated reinforcing alignment components for the positioning of the concrete reinforcing rods prior to concrete placement, with the configuration of the reinforcing alignment elements being either molded in place or being installed after the buck is manufactured. The reinforcing alignment elements can be made in a variety of configurations with the main aspect being that they integrate or connect with the internal fastening and tie elements providing an additional bond back to the concrete core.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE DRAWINGS

Figure 1:
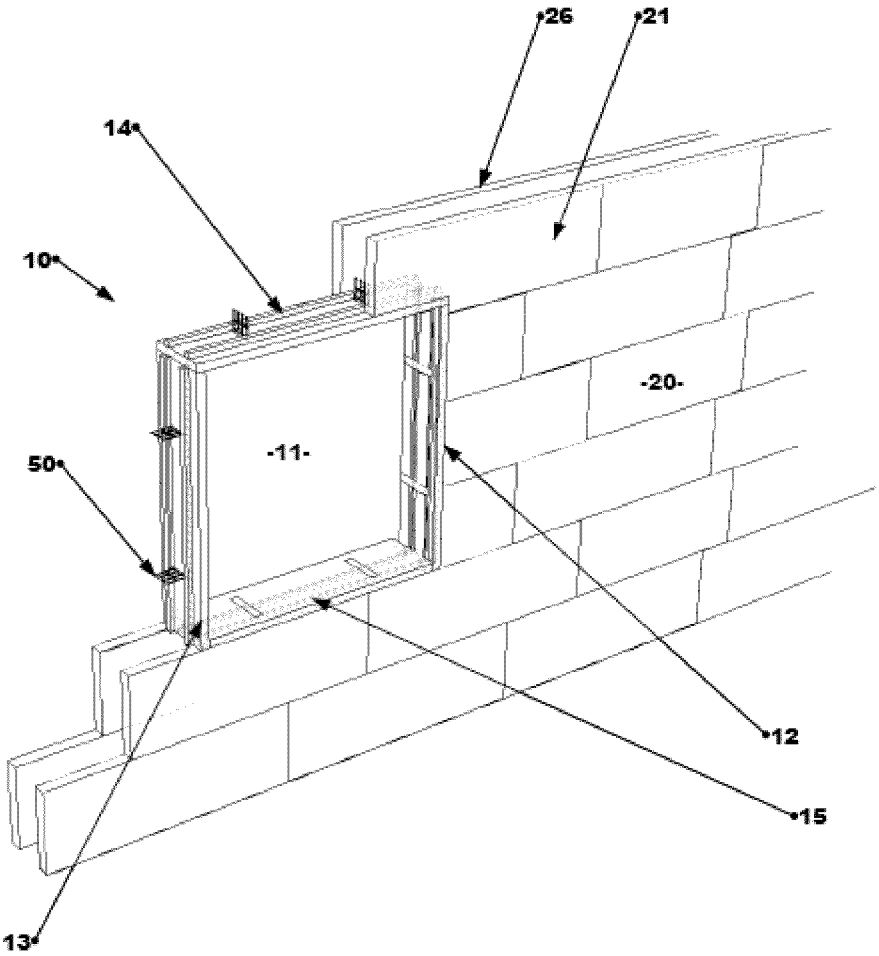
FIG. 1 is an upper perspective view of the present invention showing an upper left isometric view of an assembled window buck frame with a rough opening.
Figure 2:
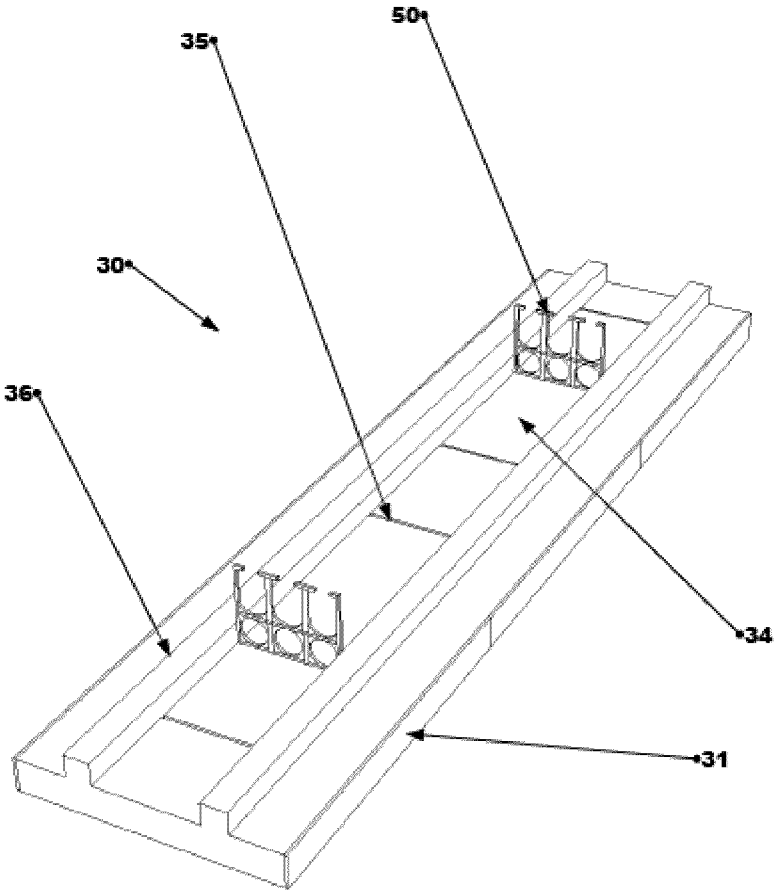
FIG. 2 is an upper perspective view of the present invention showing a piece of molded buck section with two reinforcement alignment brackets projecting from the locations that line up with the anchor insertion points.
Figure 3:
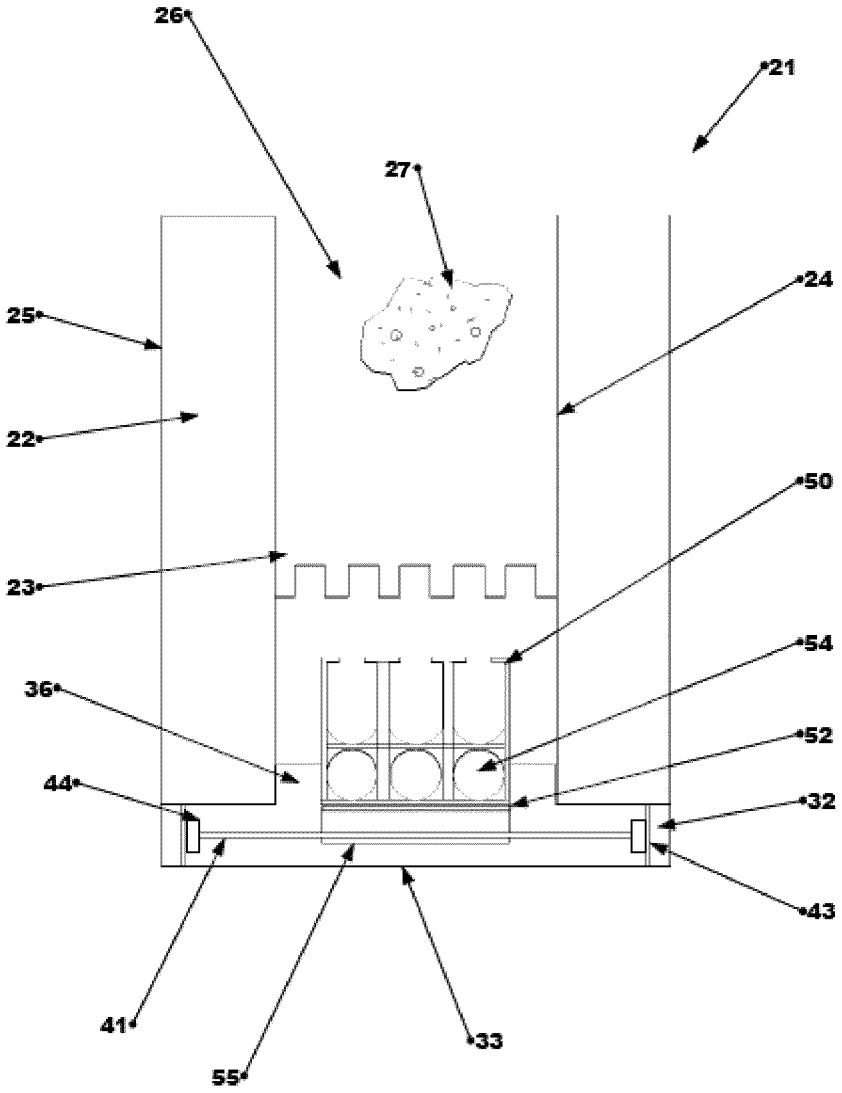
FIG. 3 is a front view of the present invention showing a section cut away view of a molded buck section installed in an ICF block with a poured concrete core.
Figure 4:
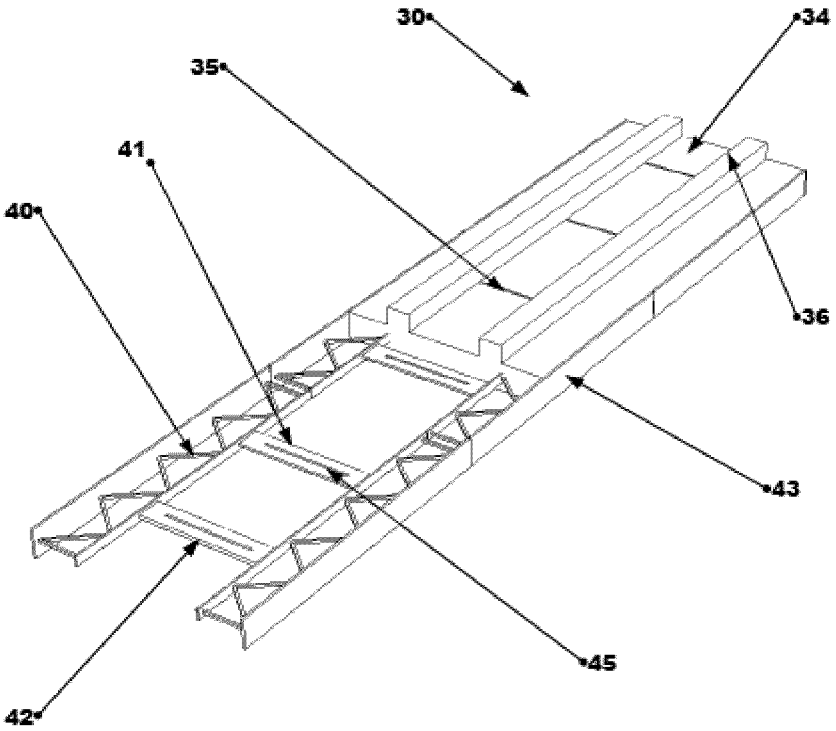
FIG. 4 is an upper perspective view of the present invention with a view of a molded buck section at one end showing the internal buck face with anchor insertion points and the insulating internal alignment elements along with edge fastening elements.
Figure 5:
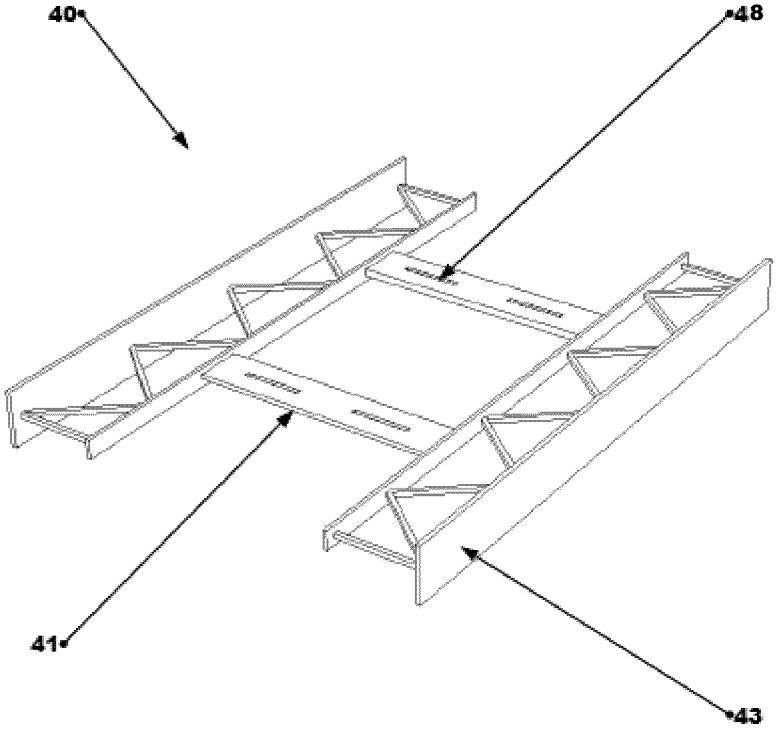
FIG. 5 is an upper perspective view of the present invention showing a buck tie and fastening element with cross tie elements that have multiple indentations or voids connections and the parallel edge fastening elements.
Figure 6:
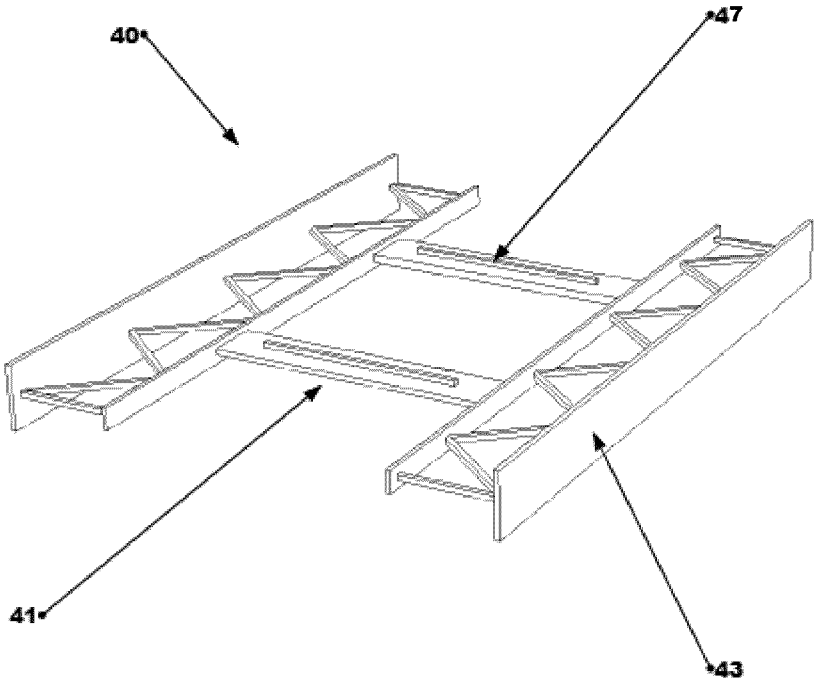
FIG. 6 is an upper perspective view of the present invention showing a buck tie and fastening element with cross tie elements that having single protruding element connections and the parallel edge fastening elements.
Figure 7:
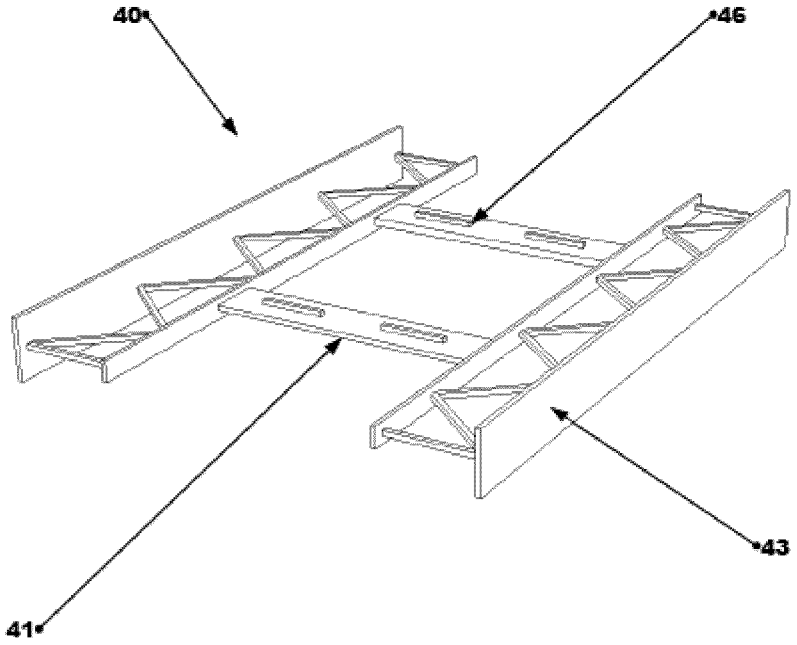
FIG. 7 is an end view of the present invention showing a buck tie and fastening element with cross tie elements that have multiple protrusion elements connections and the parallel edge fastening elements.
Figure 8:
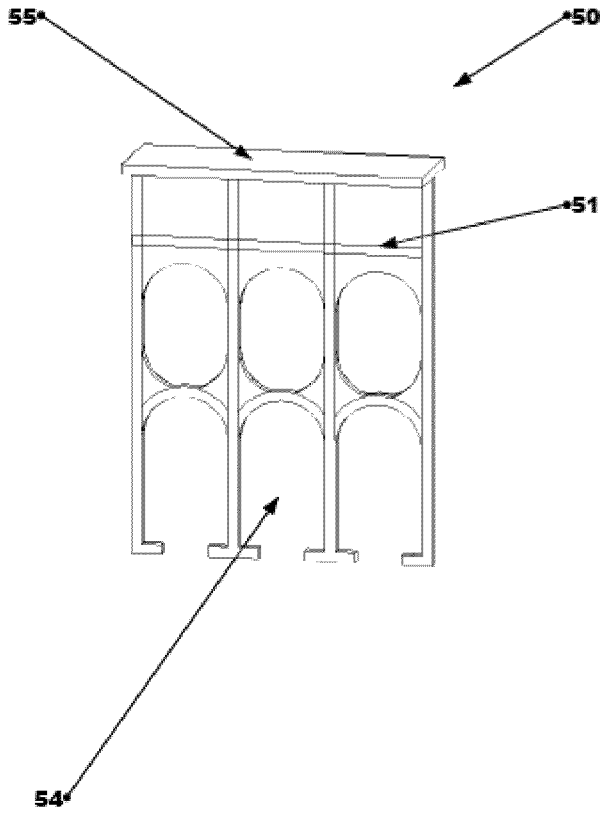
FIG. 8 is an exploded upper perspective view of the present invention showing a buck reinforcing element that is designed as a fixed alignment bracket with reinforcement slots and an end bracket fastening stop.
Figure 9:
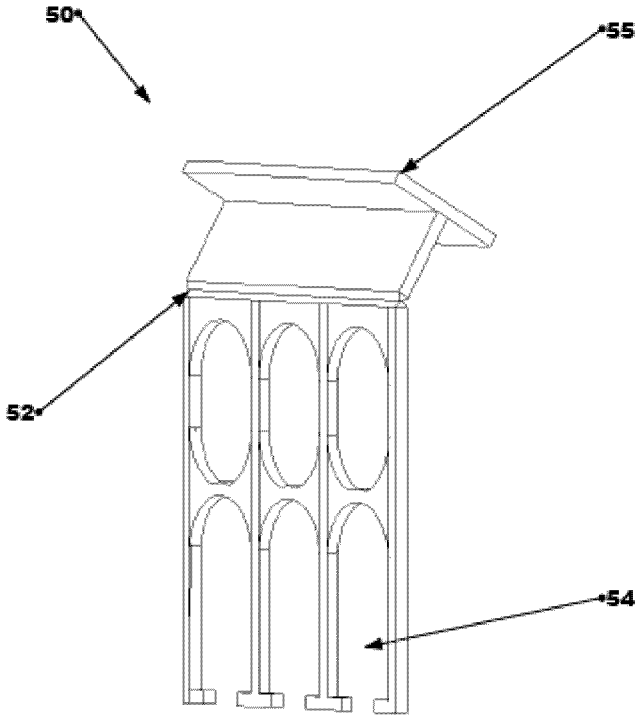
FIG. 9 is an end view of the present invention showing a buck reinforcing element that is designed as a hinged alignment bracket with reinforcement slots and an end bracket fastening stop.
Figure 10:
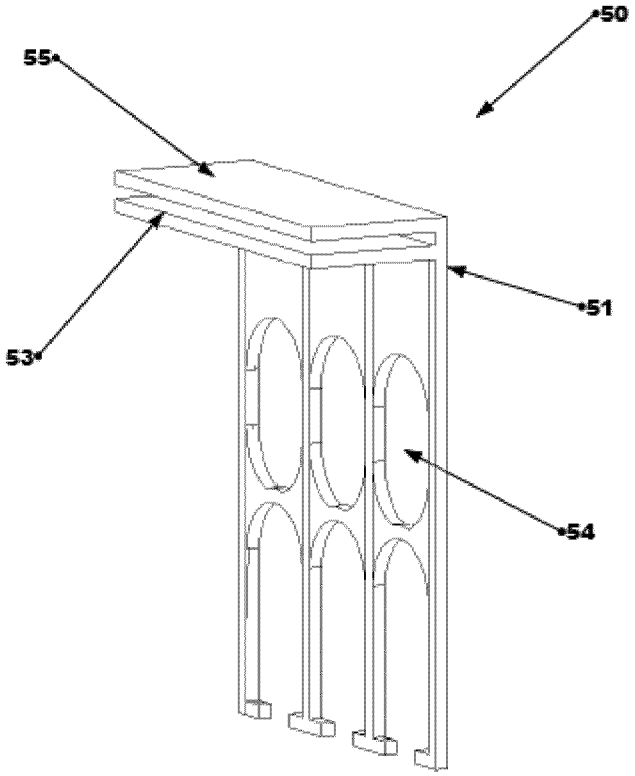
FIG. 10 is an end view of the present invention showing a buck reinforcing element that is designed as a fixed alignment bracket that is also configured as a slide or clip on alignment bracket with reinforcement slots and an end bracket fastening stop.
Figure 11:
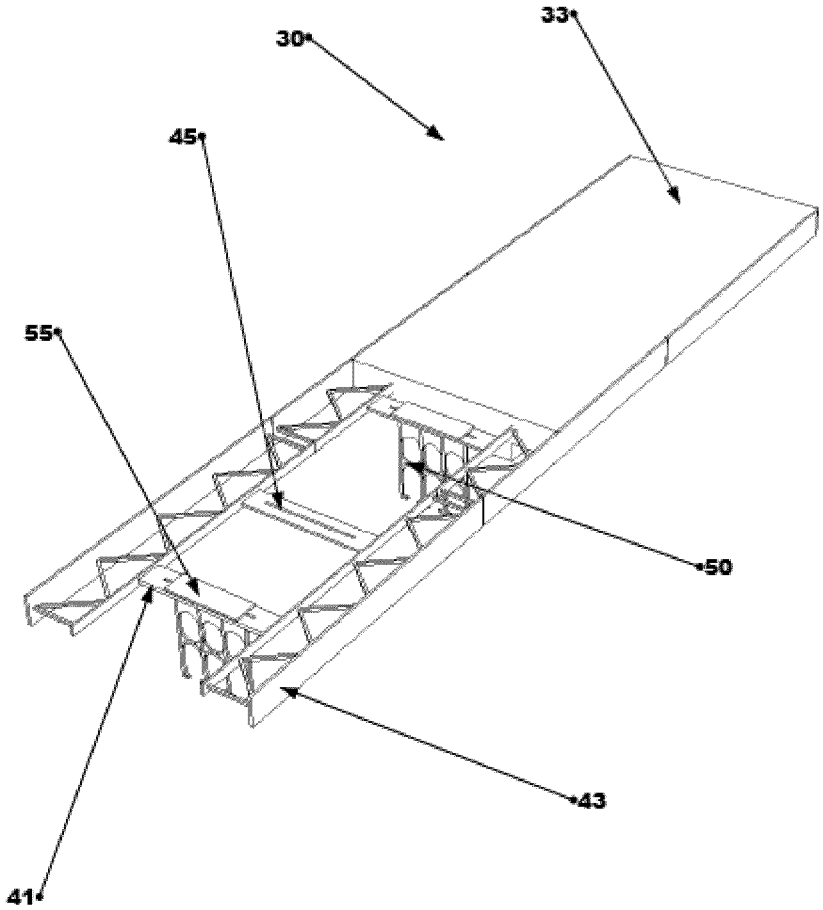
FIG. 11 is an upper perspective view of the present invention showing a molded buck section at one end, with the external buck face oriented up, along with edge fastening elements.
Figure 12:
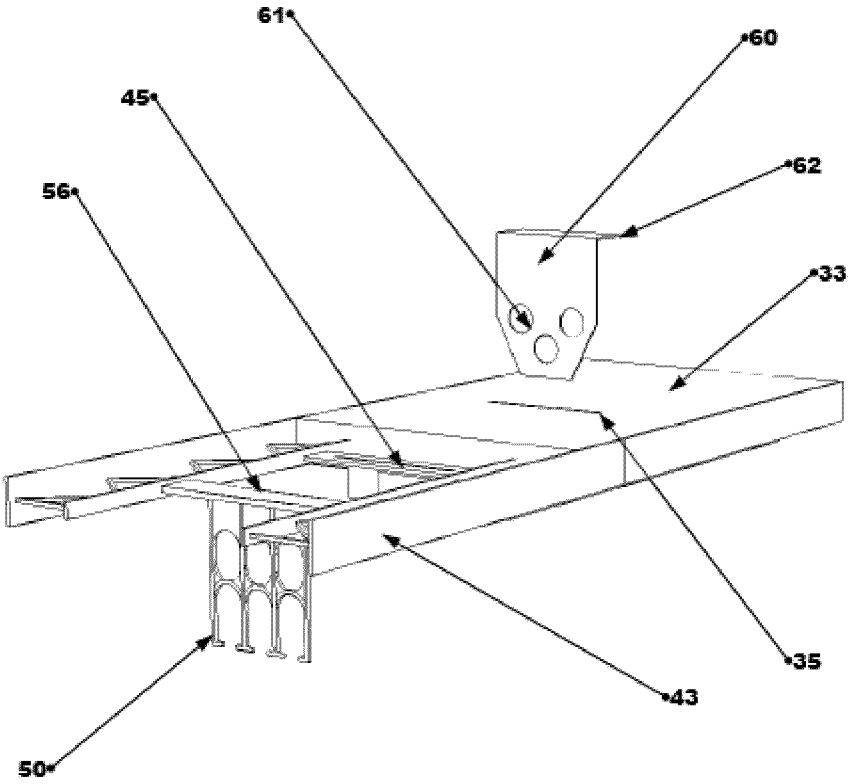
FIG. 12 is an upper perspective view of the present invention showing a molded buck section at one end which shows the external buck face along with edge fastening elements and a cut in or slide in concrete anchor and the anchor fastening flange.
Figure 13:
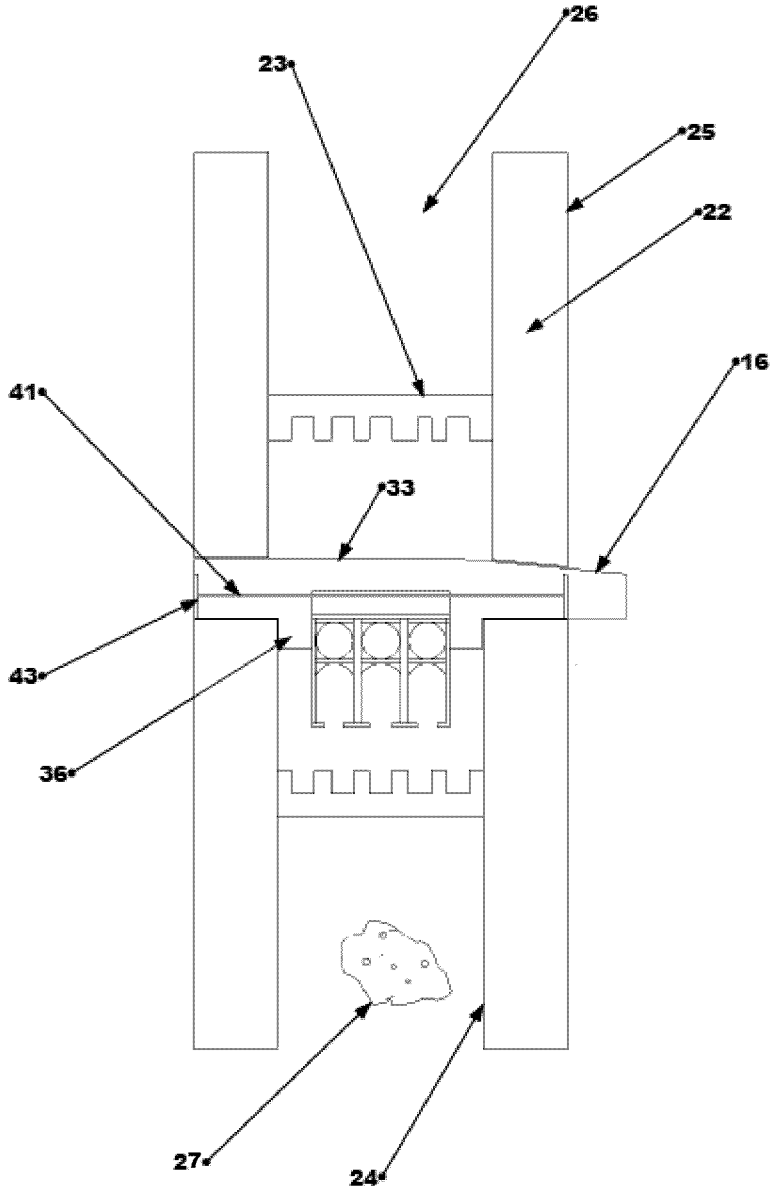
FIG. 13 is a front view of the present invention showing a section view of a sloped sill buck section within an ICF wall with a concrete core and ICF side panels with the exterior ICF panel face and ICF webs joining into the inside ICF panel face.

The present invention is referred to generally in FIGS. 1-13 by the reference numeral 10 and is intended to provide for an ICF window buck with integrated fastening and anchors. Like numbers refer to like elements throughout the figures. It should be understood that the device 10 may be used in a variety of wall forms and is not to be limited in use to only insulated concrete forms.

The molded buck frame 10 makes a rough opening 11 for window and door units, being assembled from a right side buck section 12 and a left side buck section 13 with a top buck section 14 capping the assembly. The bottom frame buck section 15 completes a square or rectangle assembled buck frame 10.

The sloped sill buck section 16 can be used for aesthetic reasons or for proper drainage of rain water or snow. Window or door frames 10 can be manufactured with without a sill section 15 or 16 in place, leaving it open to the concrete core 27 when required.

The insulated concrete formed wall 20 is typically made from individual ICF blocks 21 made up of side panels 22 that are held in proper alignment by internal spacer webs 23 spanning across the ICF wall cavity 26, with the panels having both an inside ICF panel face 24 and an exterior ICF panel face 25 and then being poured in place for a concrete wall core 27.

This buck invention can also work in any type of ICF wall 20 whether it be a flat wall system or a type of waffle grid or a post and beam ICF system or in standard formed concrete walls.

A molded buck section 30 has an exposed section face 33 and an internal section face 34 that can have anchor insertion points 35 for easier insertion of cut or slide in concrete anchors 60 which are situated to line up with the wall cavity 26 between the insulating internal alignment elements 36, another important aspect of the molded buck section is there can be incorporated an independent exposed edge fastening element 31.

The molded buck section 30 can also have buried edge fastening elements 32 or incorporate a non-insulating alignment element or a combination therof for lining up within the wall cavity 26. The anchor insertion points 35 can also be indicated on either the internal section face 34 or the exposed section face 33 or both 33 and 34.

The buck tie and fastening element 40 is made up from a cross tie 41 which can also have a cross tie anchor connection 42 with integrated parallel edge fastening elements 43. Some of the cross tie anchor connection 42 will typically include a single indentation or void connection 45 for the incorporation of cut or slide in concrete anchors 60 or the integrated of internal anchors or reinforcement alignment elements.

The cross tie 41 can have cross tie anchor connections 42 that are configured in multiple way on being multiple protruding connections 46 or single protruding connections 47 or multiple indentation or void connections 48. The integrated edge fastening elements 43 can also incorporate heavy duty connection points 44 for a stronger integrated edge fastening element 43 locations.

The internal reinforcing alignment elements 50 will typically have an integrated hinged connection 52 as well as a top fastening stop 55 that can integrate with the cross ties 41 and individual reinforcing rod openings 54 for the placing of reinforcing rods.

The internal reinforcing alignment elements 50 can be configured in multiple ways with fixed reinforcing alignment elements 51 or slide or clip on connection 53 or the entire buck tie and fastening element 40 can be manufactured with an integrated one piece reinforcing alignment element 56.

The molded buck sections 30 can have a configuration so that concrete buck anchors 60 can integrate with the buck tie and fastening elements 40. The concrete buck anchors 60 typically have an embedment element 61 that is embedded in the concrete core 27 and has a fastening flange 62 for attaching heavier loads to the exposed section face 33 of the molded buck section 30.

The concrete buck anchors 60 can have single or multiple embedment elements 61 which can be flat or round or any configured shape for embedment into the concrete core 27. The concrete buck anchors 60 can be made to integrate with the integrated edge fastening elements 43 instead of the cross ties 41 in an alternate method of providing strength and a tie to the concrete core 27 for the buck tie and fastening element 40.

The typical assemble window buck frame 10 is made from right side buck sections 12 and left side buck sections 13 that are tied together with a top buck section 14 and a bottom buck section 15 there by making a rough opening 11. Typically the assembled window buck frame 10 is installed into an insulated concrete formed wall 20 that is made up of individual insulated concrete blocks 22 which then go into making a insulated concrete formed wall 21 with the insulated concrete blocks being made with insulated concrete block webs 23 two inside panel faces 24 and two exterior panel faces 25 making up a wall cavity 26 that is filled with a concrete core 27. The sides tops and bottom buck sections of the assembled window buck frame 10 is made from molded buck sections 30 which typically have independent exposed edge fastening edge elements 31 and an exposed faces 33 that face into the rough opening 11 and the molded buck sections will also have an internal section face 34 and can have anchor insertion points 35 which are positioned to line up between the insulating internal alignment elements 36. The molded buck sections can have an integrated buck and tie and fastening element 40 with cross ties 41 which hold the integrated edge fastening elements 43 and typically have a single indentation or void connection 45 for installing either internal reinforcing alignment elements 50 or concrete buck anchors 60. The internal reinforcing alignment elements 50 are typically configured with a hinged connection 52 with a top fastening stop 55 and locations for reinforcing rod openings 54. The cross tie elements 41 can also allow for concrete buck anchors 60 with embedment elements 61 and anchor fastening flanges 62.

The variations of the molded buck section 30 range from either having an exposed independent edge fastening element 31 or a buried edge fastening element 32 as well as the internal alignment elements being insulating 36 or non-insulating. The buck tie and fastening element 40 can have several configurations for integrating with the internal reinforcing alignment bracket (mechanism) 50 by having either single indentations or voids connections 45 or multiple indentations or voids connections 48 or the cross tie elements 41 can have single protruding elements connections 47 or multiple protruding element connections 46. The internal reinforcing alignment element 50 might be a fixed alignment element 51 or a hinged alignment element 52 or it can have slide or clip on alignment elements 53 or the internal reinforcing alignment element 50 can be manufactured as a one piece reinforcing alignment element 56 by combining 50 with the cross tie element. The cross tie element can either be manufactured as a single component with the integrated edge fastening elements 43 or it can be composite in nature and be added at a later time. The internal reinforcing alignment elements 50 can also be applied to a standard ICF block 21 for the internal spacer webs 23 allowing for the incorporation of vertical and horizontal reinforcing with a add on reinforcing rod opening 54 to be placed exactly when and where needed.

As a preferred embodiment the installer first measures the correct rough opening 11 of the assembled window buck frame 10, then cuts to the correct length the molded buck sections 12,13,14,15 or 16 and then fastens them together at the intersecting joints or the individual molded buck sections 30 can be placed in the ICF wall 20 without connecting the corners. When the installer has the ICF wall block 21 stacked up to the underside of the bottom panel 15 or 16 the assembled window buck 10 can be set into position on top of the ICF wall block 21 with the internal alignment elements 36 projecting to the inside of the ICF wall cavity 26 against the inside faces of the ICF side panels 24 of the ICF wall block 21, the balance of the ICF wall blocks 21 would be installed around the assembled window buck 10. Once the wall concrete core 27 is poured into the ICF wall 20 made from ICF wall blocks 21 then the installer can install windows or doors by fastening directly into edge fastening element 43 or into cut or slide in concrete anchors 60 on the exposed face 33 of the molded buck sections 30 by fastening into the anchor fastening flanges 62 where one can fasten doors or windows into the ICF wall 20.

During the manufacture of the molded buck sections 30 the internal face 34 can have anchor insertion cavities 35 on either the internal face 34 or the exposed face 33 for the easier insertion of either cut or slide in concrete anchors 60 or the insertion of internal reinforcing alignment elements 50. As the ICF wall 20 is being built and the buck frames 10 are being installed reinforcing rods can be installed into the reinforcing rod openings 54 of the internal reinforcing alignment elements 50 for adding strength for the ICF wall 20 around the window and door openings. The hinge connection 52 of the internal reinforcing alignment elements 50 allow for the molded buck sections 30 to be stacked on top of one another for shipping and handling while the internal reinforcing alignment elements 50 fold out of the way keeping them from getting damaged and allowing for a tighter smaller load for shipping.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

What is claimed is:

1. An internally aligned insulating window and door buck that fits with insulated concrete wall forms that have two side panels having substantially parallel inside faces and that are separated from each other by a wall form cavity and exterior panel faces substantially parallel to the substantially parallel inside panel faces, said buck comprising:

a rough open frame system comprising a top buck piece, and side buck pieces, each said buck piece having an exterior surface, an internal surface, and outer faces that join the exterior surface and the internal surface, said side buck pieces being joinable to the top buck piece to thereby form a rough opening frame assembly wherein the exterior surfaces of the buck pieces define an opening, with at least one of the buck pieces being a composite comprising an internal alignment element and molded insulation at least partially molded over an integrated buck-and-tie fastening element, wherein the internal alignment element comprises a first alignment face and a second alignment face, a first substantially flat face that connects a first of the outer faces of the buck to the first alignment face, and a second substantially flat face that connects a second of the outer faces to the second alignment face, with said alignment faces being substantially perpendicular to said first substantially flat face and second substantially flat face, the internal alignment element being proportioned to fit inside the wall form cavity of the insulated concrete wall form to position the buck for concrete placement with the internal alignment faces in contact with the inside faces of the insulated concrete wall form with said buck-and-tie fastening element comprising a flange serving as an edge fastening element to allow for the attachment of a finish material, with the buck-and-tie fastening element extending substantially from one of the outer faces to the other outer face, and with the exterior surface of the buck being continuous and substantially flat.

2. The buck of claim 1 wherein the edge fastening element is exposed on at least one of the outer faces.

3. The buck of claim 1 wherein the edge fastening element is at least partially encompassed by the insulation.

4. The buck of claim 1 wherein the finish material is for a window or for a door unit.

5. The buck of claim 1 further comprising at least one marking denoting a location of the buck-and-tie fastening element, the marking being on the exterior surface or at least one of the outer faces.

6. The buck of claim 1 further comprising at least one of a concrete anchor and a rebar holder.

7. The buck of claim 1 wherein at least one of a concrete anchor anda rebar holder is positioned in the buck for attachment to a window or a door unit.

8. The buck of claim 1 further comprising a concrete anchor that comprises voids or structures to embed the concrete anchor into concrete.

9. The buck of claim 1 further comprising a fixed concrete anchor attached to the buck-and-tie fastening element.

10. The buck of claim 1 further comprising a concrete anchor attached to the buck-and-tie fastening element with a hinged or bendable connection that allows the anchor to be folded relative to the buck.

11. The buck of claim 1 further comprising a removable concrete anchor.

12. The buck of claim 1 further comprising a rebar holder that comprises voids to embed the rebar holder into concrete.

13. The buck of claim 1 further comprising a fixed rebar holder attached to the buck-and-tie fastening element.

14. The buck of claim 1 further comprising a rebar holder wherein the rebar holder comprises a hinged or bendable connection that allows the rebar holder to be folded relative to the buck.

15. The buck of claim 1 further comprising a removable rebar holder.

16. The buck of claim 1 wherein the buck-and-tie fastening element comprises an indentation, slot, hole, protrusion, slide, or clip to receive at least one of a concrete anchor and a rebar holder.

17. The buck of claim 1 further comprising a bottom buck piece, with the side buck pieces being joinable to the bottom buck piece.

18. The buck of claim 1, wherein the flange is a first flange, with the buck-and-tie fastening element comprising a second flange that is substantially parallel to the first flange, with the first flange and the second flange being joined by a cross tie, with a cross-section through the cross tie and the first flange and the second flange having an I-beam shape.

19. The buck of claim 1 wherein the buck-and-tie fastening element comprises a plurality of individual cross ties at regular intervals along a length of the buck-and-tie fastening element.

20. The buck of claim 19 wherein the cross ties are substantially perpendicular to the flange.

* * * * *